US006840605B2

(12) United States Patent
Hauck

(10) Patent No.: US 6,840,605 B2
(45) Date of Patent: Jan. 11, 2005

(54) METHOD FOR REGULATING PRESSURE

(75) Inventor: Mark Hauck, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 59 days.

(21) Appl. No.: 09/851,633

(22) Filed: May 8, 2001

(65) Prior Publication Data

US 2001/0019347 A1 Sep. 6, 2001

Related U.S. Application Data

(63) Continuation of application No. 09/239,504, filed on Jan. 28, 1999, now Pat. No. 6,250,747.

(51) Int. Cl.[7] ..... B41J 2/175

(52) U.S. Cl. ..... 347/86

(58) Field of Search ..... 347/14, 17, 19, 347/85–87, 92

(56) References Cited

U.S. PATENT DOCUMENTS

| | | | | | |
|---|---|---|---|---|---|
| 5,220,345 | A | | 6/1993 | Hirosawa | 347/17 |
| 5,719,609 | A | | 2/1998 | Hauck et al. | 347/85 |
| 5,847,734 | A | * | 12/1998 | Pawlowski | 347/86 |
| 5,880,748 | A | | 3/1999 | Childers et al. | 347/6 |
| 5,923,353 | A | | 7/1999 | Boyd et al. | 347/85 |
| 5,992,990 | A | | 11/1999 | Childers et al. | 347/87 |
| 6,039,442 | A | | 3/2000 | Hagiwara et al. | 347/89 |
| 6,250,747 | B1 | * | 6/2001 | Hauck | 347/86 |

* cited by examiner

*Primary Examiner*—Michael Nghiem
(74) *Attorney, Agent, or Firm*—Timothy F. Myers

(57) ABSTRACT

A print cartridge is used in a printing system in which there is a requirement to provide two distinct rates of ink usage corresponding to two different types of printing done with the printing system. The print cartridge includes an ink replenishment path which selectively provides two flow rates into the print cartridge. The print cartridge also includes a controller which selects one of the two flow rates into the print cartridge based on which type of printing is being performed by the printing system.

6 Claims, 15 Drawing Sheets

METHOD FOR REGULATING PRESSURE

CROSS REFERENCE TO RELATED APPLICATION

This is a continuation of copending application Ser. No. 09/239,504 filed on Jan. 28, 1999 now U.S. Pat. No. 6,250,747.

FIELD OF THE INVENTION

The present invention generally relates to ink-jet printing, and more particularly, to apparatus and methods for delivering fluid to printheads while maintaining control of back-pressure within the printhead.

BACKGROUND OF THE INVENTION

The art of ink-jet technology is relatively well-developed. Commercial products of recording or printing apparatus such as computer printers, graphics plotters, and facsimile machines employ ink-jet technology for producing recorded media. Hewlett-Packard's contributions to this technology, ink-jet in particular, are described in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992), and Vol. 45, No. 1 (February 1994).

A ink-jet image is formed when drops are ejected from a drop-generating device known as a "printhead" to form precise patterns on a recording medium such as paper, vellum, or acrylic slide material to name a few. The drop-generating device uses any suitable technology for selectively depositing ink on media such as thermal ink-jet or piezo to name a couple. In the case of thermal ink jet, a typical ink-jet printhead has an array of precisely formed nozzles attached to a thermal ink-jet printhead substrate. This substrate incorporates an array of ink ejection chambers that receive liquid fluid, such as ink, from a fluid reservoir in a print cartridge containing the printhead. Each ink ejection chamber in the printhead has a thin-film resistor, known as a "firing resistor," located opposite each nozzle so fluid can collect between the firing resistor and the nozzle. When the firing resistor is selectively activated, a small volume of fluid adjacent the firing resistor is heated, vaporizing a bubble of fluid, and thereby ejecting a drop of fluid from the printhead. The droplets strike the recording medium and then dry to form "dots" that, when viewed together, form the recorded image.

In general, the fluid in the fluid reservoir within the print cartridge has an operating pressure chosen with at least two limiting conditions. First, the operating pressure must be sufficiently negative, creating a "back-pressure", so that during printhead operation fluid does not run freely through the ink ejection chambers and exit from the nozzles. This phenomenon must not be too negative so that when the firing resistor is heated, the vaporized bubble of fluid can overcome this operating back-pressure and eject a droplet of fluid from the ink ejection chamber. Most printheads today operate in a slight vacuum, typically in a gauge pressure range of between about −2 inches (minus two inches) of water to about −10 inches (minus ten inches) of water. Gauge pressure is pressure measured relative to atmospheric pressure outside of the print cartridge. Atmospheric pressure outside of the print cartridge is defined as 0 (zero) inches of water.

Some ink-jet printheads are located in printers or other media-recording apparatus having pressurized fluid supplies. Pressurized fluid systems enable fluid to be supplied to the printhead at higher fluid flow rates than non-pressurized systems, thus allowing for greater reliability and high print rate printing for applications such as large format or high density printing. The fluid in typical pressurized systems is pressurized from a fluid source to a supply pressure of between about +30 inches (plus thirty inches) of water to about +3 inches and is delivered to the printhead using either a tube or a conduit. A back-pressure regulator is normally located near the printhead, such as in a print cartridge containing the printhead, to reduce the supply pressure of the fluid down to the operating pressure required of the printhead.

Consumers, particularly of digital photography, are demanding fast printing speeds and photographic film quality results. To meet these consumer demands, as well as others, requires substantially increasing the rate of fluid ejected from the printhead. Another problem encountered when printing photographs onto recording medium at high speed is that the fluid leaving the printhead causes the back-pressure within the reservoir of the print cartridge to change, sometimes abruptly. Consistent drop volume for the fluid ejected is required for photographic quality, however, the drop volume is affected by the changing back-pressure. Printing at these high use rates requires that the regulator have a faster response time than required with low use rates to maintain adequate back-pressure regulation. If the back-pressure regulator cannot provide new fluid fast enough, the pressure will drop sufficiently low that the fluid ejected from the printhead will either cease or the quality of the drop will diminish. Conversely, if the flow of fluid into the reservoir from the back-pressure regulator is too great, the ability of the back-pressure regulator to stabilize sufficient back-pressure is affected when only low volumes of fluid are ejected from the printhead. It is essential that the drop volume of the fluid ejected from the printhead be consistent to achieve high print quality. Achieving consistent drop volume requires that the back-pressure range be controlled to an ever finer levels.

Another requirement for an improved back-pressure regulation is to accommodate air that is built up over time within the print cartridge reservoir. This air is introduced by diffusion through system components or tubing, at fluid interconnects in the pressurized system, or from air that has been released from the fluid itself through out-gassing. A pressurized system can introduce air either during refilling or replacement of the main fluid source. This air can also be released from the fluid either during changes in temperature or atmospheric pressure changes due to weather or elevation. Size constraints on the print cartridge often provide a limited capacity for warehousing air within a reservoir of fluid within the print cartridge. If the amount of air within the reservoir of the print cartridge becomes too large, either the print cartridge will not be able to supply a sufficient amount of ink during high speed, high density printing, or it may not allow the back-pressure regulator to operate properly. In addition, large amounts of air will respond to changes in atmospheric pressure and/or temperature. These responses may cause the printhead to drool (the air expanding) or to deprime (the air contracting). Depriming occurs when the ink within the printhead is drawn back into the reservoir. Therefore air within the reservoir causes the printing system to have a reduction in visual quality or to simply fail to work properly.

SUMMARY

A print cartridge is used in a printing system in which there is a requirement to provide at least two distinct rates of ink usage corresponding to at least two different types of printing done with the printing system. The print cartridge includes an ink replenishment path which selectively provides at least two flow rates into the print cartridge. The print cartridge also includes a controller which selects one of the at least two flow rates into the print cartridge based on which type of printing is being performed by the printing system.

The print cartridge can further include a removal path which is operated by the controller in response to gauge pressure sensed within the print cartridge. This removal path allows for the extraction of excess air and ink in order to allow the gauge pressure within the print cartridge to be regulated within a predetermined range that is suitable for the type of printing being performed by the printing system.

One aspect of the print cartridge has a reservoir containing a quantity of fluid. The print cartridge has a first valve defining a first fluid path between a fluid source and the reservoir, and a second valve defining a second fluid path between the fluid source and the reservoir, the second fluid path being different from the first fluid path. The print cartridge has a controller which is linked to each of the first and second valves. The controller, in response to gauge pressure sensed in the reservoir, modulates each of the first and second valves to provide fluid flow in the first and second fluid paths, respectively.

DETAILED DESCRIPTION OF THE PREFERRED AND ALTERNATE EMBODIMENTS

The invention provides for tighter back-pressure regulation in a print cartridge. Print cartridges can have several meanings depending on the type of printer they are used in. A print cartridge for an off-axis printer is generally smaller than a print cartridge for an on-axis printer. An off-axis printer generally contains an ink source that is "off-axis", that is the ink source is not placed within the axis used to move the print cartridge across the recording medium. Since the ink source does not have to move with the print cartridge, the print cartridge is able to print faster due to its lower mass. An on-axis printer generally combines the ink source within the print cartridge. While the print cartridge is typically larger than an off-axis print cartridge, the user benefits by being able to quickly replace an empty or defective print cartridge. The instant invention is intended to provide tight back-pressure regulation for either an off-axis or on-axis type print cartridge.

Figure 1:
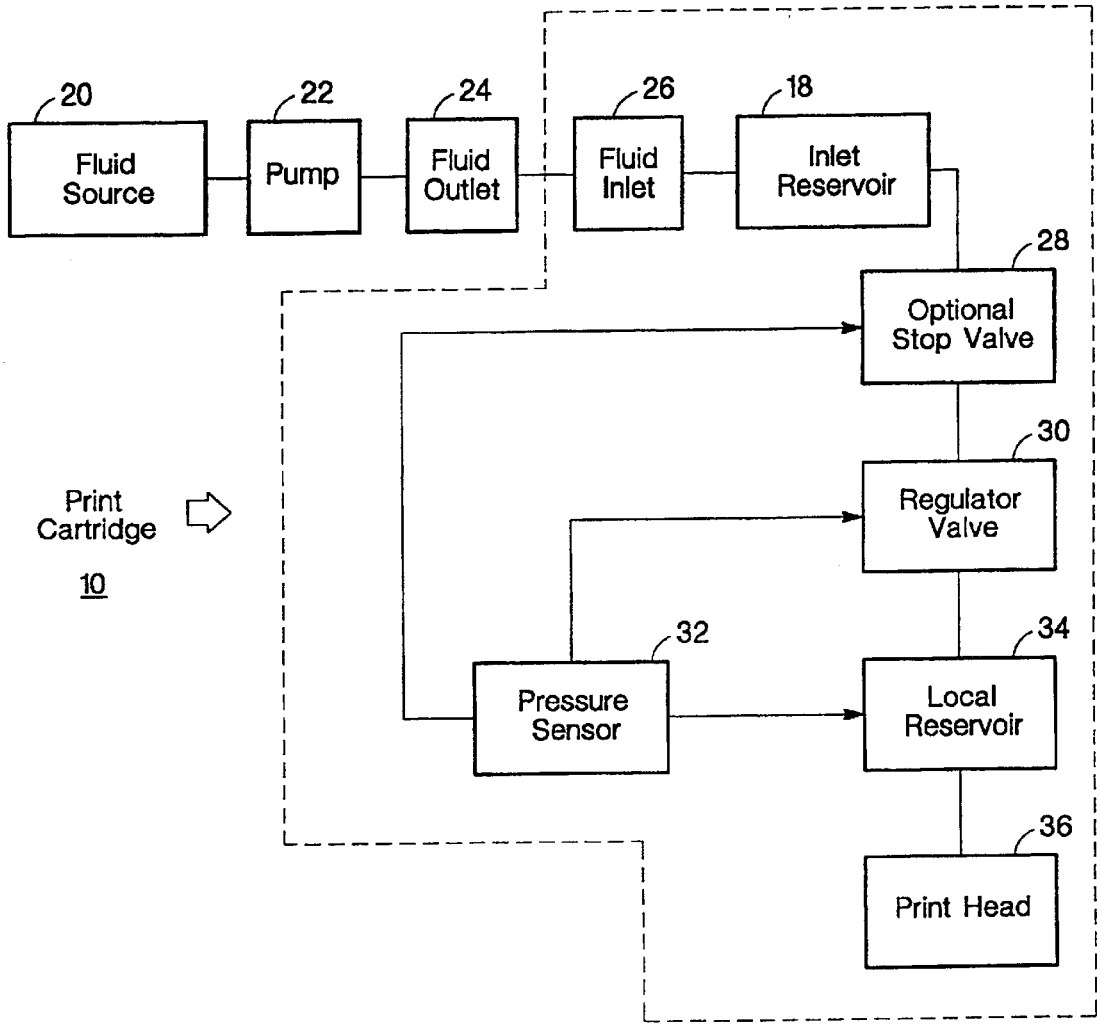
FIG. 1 is a block diagram of a previously described back-pressure regulator which uses multiple valves.

FIG. 1 illustrates a previously described approach to back-pressure regulation using multiple valves in commonly assigned U.S. Pat. No. 5,719,609. In this approach a fluid source 20 provides a fluid under pressure using pump 22 to a fluid outlet 24. The pump 22 is of conventional construction and pressurizes the fluid to a supply gauge pressure of about +30 inches of water to +90 inches of water. Note that gauge pressure is used within the specification to describe the pressure within a structure with respect to the pressure outside of the structure. For instance, a gauge pressure of 0 (zero) inches of water is the level of atmospheric pressure outside of the pump 22. The fluid outlet 24 is fluidically coupled to a print cartridge 10 that includes a fluid inlet 26, an inlet reservoir 18, an optional stop valve 28, a regulator valve 30, a local reservoir 34, a pressure sensor 32, and a printhead 36. The fluid outlet 24 interfaces with fluid inlet 26 to provide the pressurized fluid to the print cartridge 10. A back-pressure regulator made up of optional valve 28, regulator valve 30, and pressure sensor 32 controls the pressure of the fluid in local reservoir 34 before it is supplied to printhead 36. The pressurized fluid from fluid source 20 ensures that the fluid reliably reaches the print cartridge 10 at high flow rates from the printhead 36. However, if the fluid pressure within local reservoir 34 were not lowered below atmospheric pressure, the fluid would be forced out of printhead 36 causing drooling. Therefore, it is important that the back-pressure regulator control the pressure of the fluid in local reservoir 34 such that it maintain a negative gauge pressure (relative to atmospheric pressure external to the print cartridge 10) such as in an exemplary range of −2 to −10 inches of water. When the printhead 36 expels fluid, it must provide a force overcoming this back-pressure in the local reservoir 34. When the fluid is expelled, it alters the back-pressure value and the back pressure regulator must compensate for this. If the back-pressure could be maintained in a tighter range than done with conventional regulators, the amount of fluid ejected and its velocity could be more accurately controlled thus allowing for better print quality and faster printing.

The optional stop valve 28 provides a method of preventing the pressurized fluid from fluid source 20 from entering the local reservoir 34 if regulator valve 30 does not close completely. If regulator valve 30 does not close completely, the pressure within local reservoir 34 increases causing the optional stop valve to close when a set value is reached. Also the pressure can rise if the quantity of air contained in the local reservoir 34 becomes too large a portion of the volume of local reservoir 34, the optional stop valve will then close once the set pressure level is reached to limit drooling from the printhead. The optional stop valve does not, however, do anything to remove the excess air from local reservoir 34.

Figure 2:
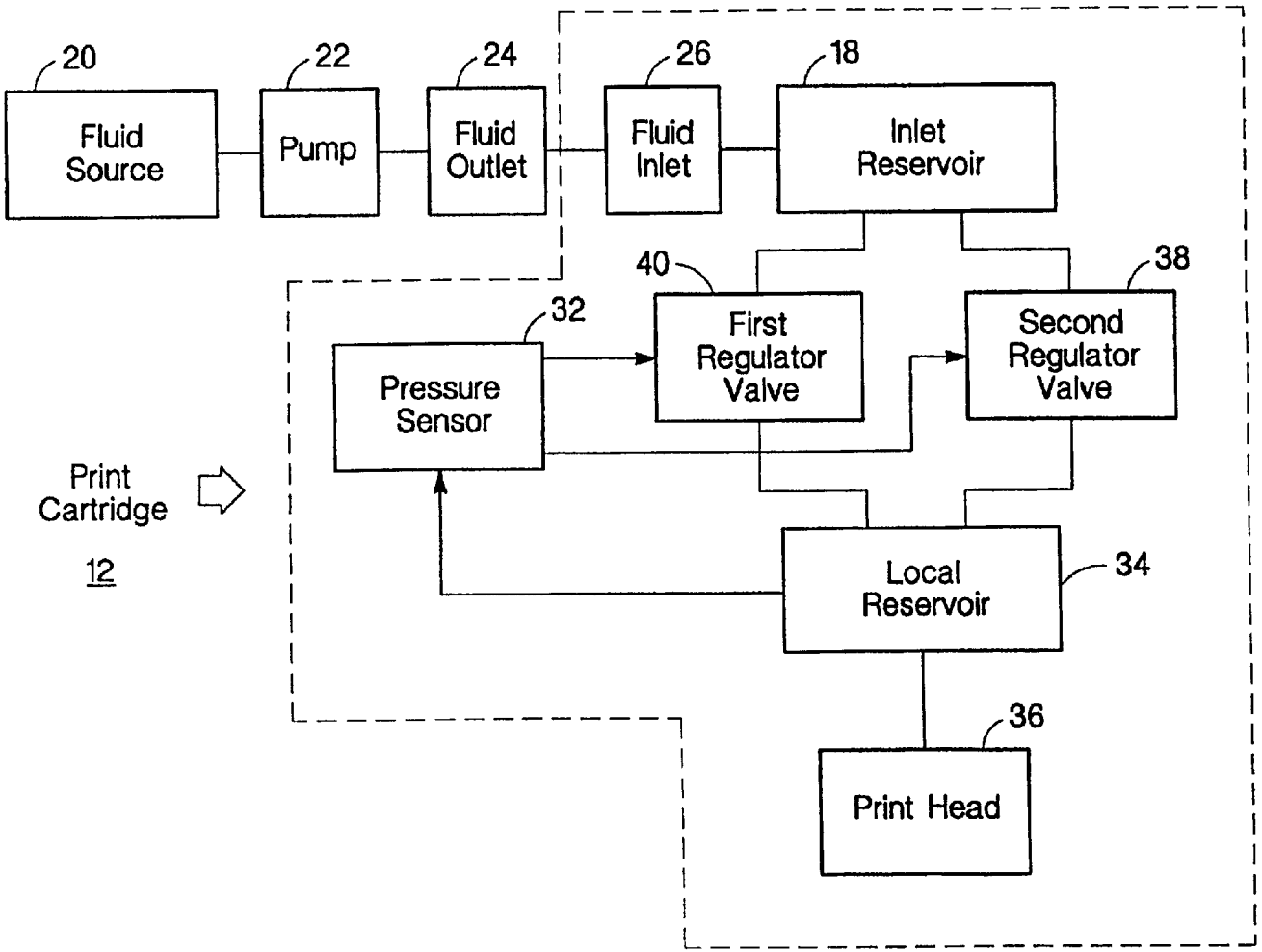
FIG. 2 is a block diagram of one embodiment of the back-pressure regulator of the present invention which makes use of staged flows.

FIG. 2 illustrates a block diagram of an embodiment of a printing system which includes pressure regulation techniques of the present invention. The printing system contains a print cartridge 12 that has a back-pressure regulator made up of a first regulator valve 40, a second regulator valve 38, and a pressure sensor 32. This back-pressure regulator allows fluid from fluid inlet 26 to enter the local reservoir 34 while maintaining the back-pressure in local reservoir 34 within a predetermined range.

The back-pressure regulator provides this improved back-pressure regulation by providing aggregated flows of fluid in stages, that is, multiple fluid flow through different fluid flow paths from the fluid inlet 26 and inlet reservoir 18 to the local reservoir 34. Each fluid flow path has a regulator, such as a valve, associated with the respective fluid flow path for controlling the fluid flow between the fluid inlet 26 and the local reservoir 34. This staged fluid flow is provided by having pressure sensor 32, when it detects a first pressure threshold, to open the first regulator valve 40. If the fluid exiting printhead 36 exceeds the fluid entering through the first regulator valve 40, the back-pressure in local reservoir 34 will become more negative. When pressure sensor 32 detects that the back-pressure has reached a second pressure threshold, it opens the second regulator valve 38 which provides additional fluid to enter local reservoir 34. If the combined fluid flows from first regulator valve 40 and second regulator valve 38 are greater than the fluid exiting printhead 36, then the back-pressure in local reservoir 34 will become more positive. When the pressure sensor 32 detects that the back-pressure is greater than the second pressure threshold, then it closes the second regulator valve 38. If the printhead 36 reduces the amount of exiting fluid such that the back-pressure in local reservoir 34 is detected by the pressure sensor 32 as greater than the first pressure threshold, then the first regulator valve is closed to maintain the back-pressure in local reservoir 34, which prevents drooling of fluid from printhead 36. This back-pressure regulator provides better regulation of the pressure within the local reservoir 34 which provides consistent drop volume of fluid ejected from the printhead 36 resulting in higher print quality.

Figure 3:
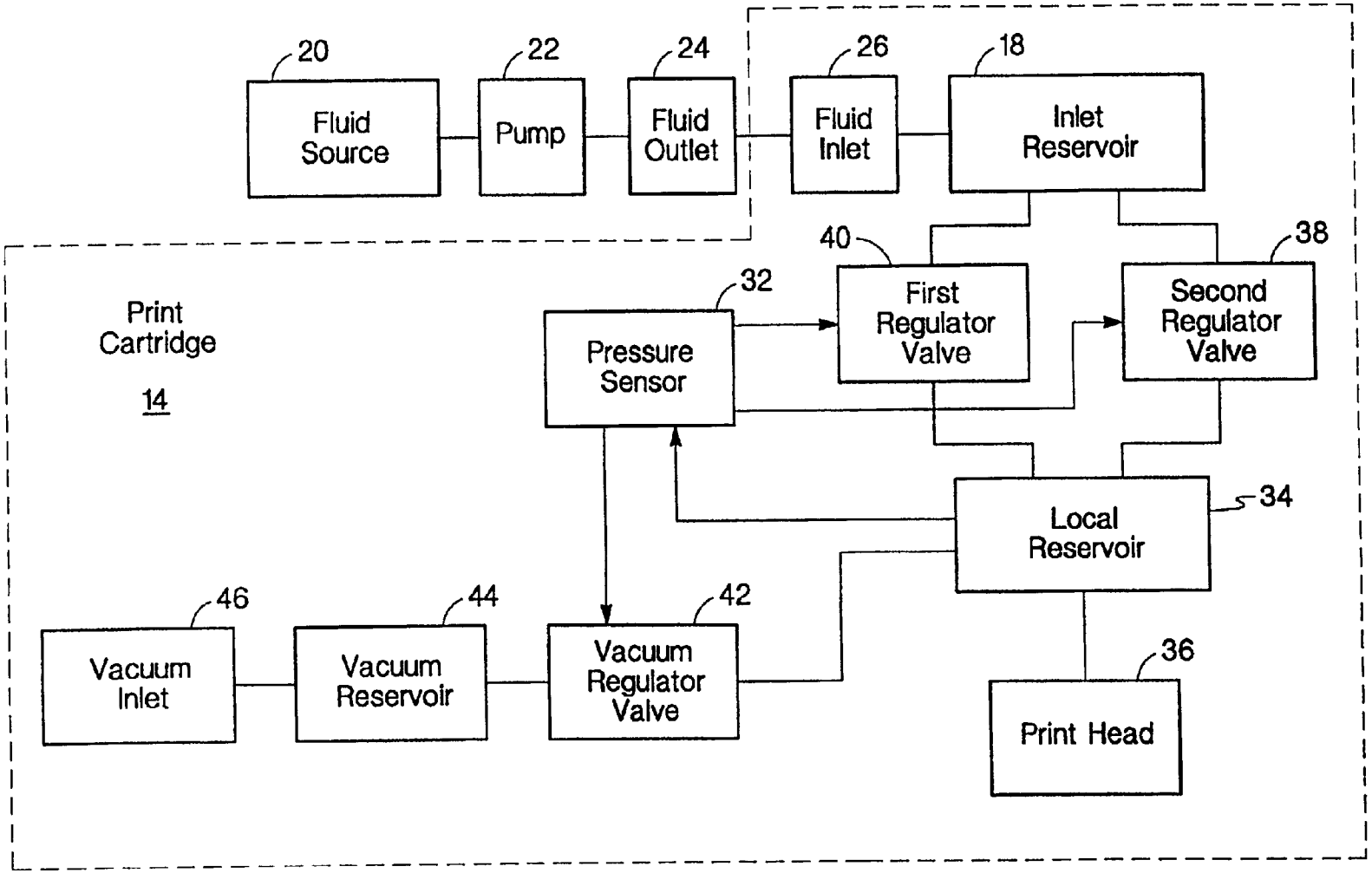
FIG. 3 is a block diagram of an alternative embodiment of the back-pressure regulator of the present invention using air purge capability along with the staged flows to further control the back-pressure of a print cartridge.

FIG. 3 illustrates another block diagram of an embodiment of a printing system using one technique of back-pressure regulation in the invention in which the back-pressure regulator in print cartridge 14 further includes a vacuum regulator valve 42 controlled by pressure sensor 32. This vacuum regulator valve 42 is disposed between the local reservoir 34 and a vacuum reservoir 44, which is connected to a vacuum inlet 46. If air is contained in local reservoir 34, the back-pressure in local reservoir 34 can become more positive due to fluctuations in ambient pressure or temperature, even if the first regulator valve 40 and the second regulator valve 38 are closed. If pressure sensor 32 detects that the back-pressure in local reservoir 34 approaches a third pressure threshold, then vacuum valve 42 opens, and air, and possibly some fluid, from local reservoir 34 is drawn into vacuum reservoir 44. This action actively causes the back-pressure in local reservoir 34 to become more negative until the pressure sensor 32 detects that the back-pressure is below the third pressure threshold causing vacuum valve 42 to close. A continuous vacuum can be created in vacuum reservoir 44 by having a vacuum source connected to vacuum inlet 46, or it can be created intermittently by periodically evacuating vacuum reservoir 44. By having the vacuum regulator valve 42 actively respond and correct for pressure changes, the first regulator valve 40 can be eliminated and back-pressure stability at low fluid flows through the printhead 36 can still be maintained.

Figure 4:
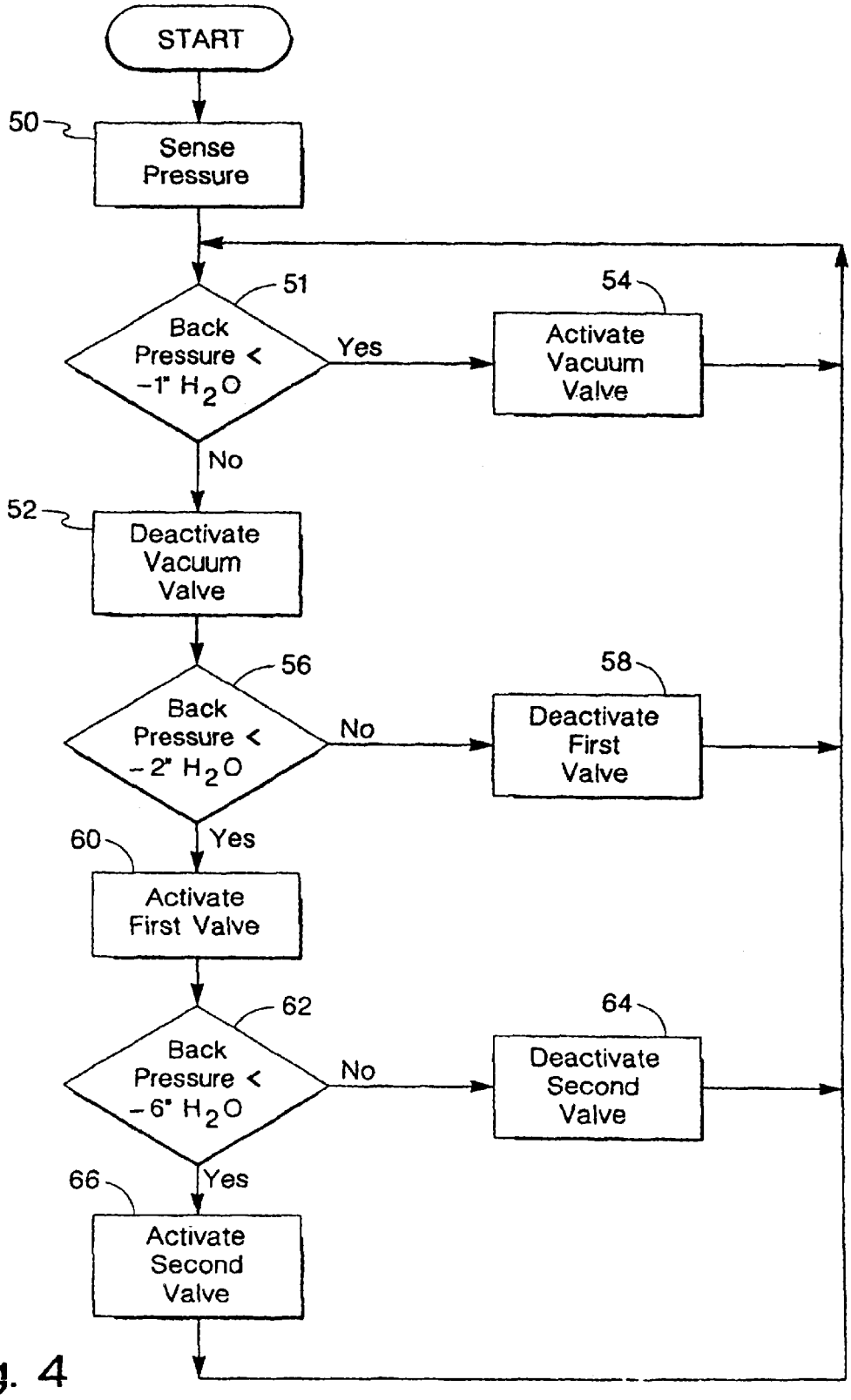
FIG. 4 is a flow chart of a process of the present invention for providing improved back-pressure regulation using the multiple valves illustrated in FIG. 2 and FIG. 3.

FIG. 4 illustrates an exemplary process for controlling the back-pressure within the local reservoir 34 of the print cartridge block diagram of FIG. 3. In this example, a desired predetermined back-pressure range from −2 to −6 inches of water, is assumed. This example also assumes that when the back-pressure reaches a pressure of −1 inch of water that enough air has accumulated in the local reservoir 34 such that it needs to be evacuated to prevent drooling of fluid from the printhead 36. The process would start by using the pressure sensor 32 to sense the back-pressure in block 50. In decision block 51, the back-pressure is checked to determine if it is greater than −1 inch of water. If so, then the vacuum valve is activated in block 54 to allow the air accumulated in the local reservoir to be drawn into the vacuum reservoir, thus lowering the back-pressure. The process then returns to block 50. In decision block 51, if the back-pressure is less than −1 inch of water, then in block 52 the vacuum valve 42 is deactivated to prevent any further air or fluid from reaching the vacuum reservoir 44. In block 56, the pressure is checked to determine if it is less than −2 inches of water. If it is not then the first regulator valve 40 is deactivated in block 58 to prevent fluid from the fluid inlet 26 from entering the local reservoir and increasing the pressure. The process would then return to block 50. In block 56, if the pressure is less than −2 inches of water, then in block 60, the first regulator valve 40 is activated to allow fluid to flow into the local reservoir 34 from fluid inlet 26 thus raising the pressure within local reservoir 34. If the printhead is expelling fluid at a volumetric rate greater than the fluid entering the first regulator valve 40, however, the amount of fluid within local reservoir 34 will decrease, and the pressure inside it will continue to drop. In decision block 62, the pressure is checked to determine if the maximum negative pressure of −6 inches of water is reached. If it has not been reached, then the second regulator valve 38 is deactivated in block 64 and the process returns to block 50. If the maximum negative pressure of −6 inches of water has been reached, then in block 86, the second regulator valve 38 is activated to increase the flow of fluid into the local reservoir 34. The process then returns to sensing the back-pressure in block 50. By performing these steps, the back-pressure within local reservoir 34 can be maintained within an exemplary tight range of −2 to −6 inches of water. If the air released from the fluid in local reservoir 34 over time causes the minimum negative pressure to increase from −2 to −1 inches of water, then the vacuum valve will be activated to expel the air inside local reservoir 34 so as to prevent the back-pressure from getting higher than −1 inches of water. This pressure value of −1 inches of water will prevent the drooling of fluid from the printhead 36.

Figure 5A:
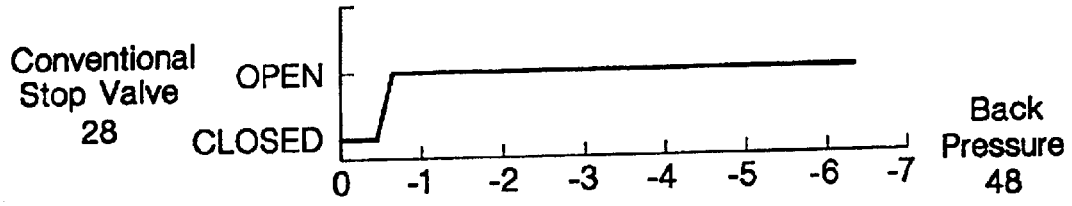
FIG. 5A is a graph showing the operation of a previously described stop valve versus the back-pressure in a print cartridge.

FIG. 5A is a chart illustrating the operation of the previously described stop valve versus the back-pressure of local reservoir 34 in a previously described print cartridge as illustrated in the block diagram of FIG. 1. In this instance, when the back-pressure rises to between 0 and −1 inch of water, the stop valve is closed, thus preventing any flow of fluid into the local reservoir 34 and minimizing drooling of ink from the print cartridge.

Figure 5B:
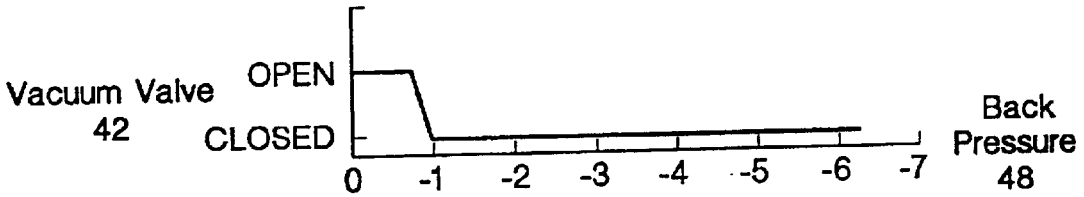
FIG. 5B is a graph showing the operation of a first valve used in the embodiment of the invention versus the back-pressure in a print cartridge.

FIG. 5B is an exemplary chart of the operation of the vacuum regulator valve 42 of FIG. 3 versus the back-pressure sensed by the pressure sensor 32. In this example, when the pressure within the local reservoir 34 rises between −1 and 0 inches of water, the vacuum regulator valve 42 is activated to evacuate the air from the local reservoir 34. By evacuating the air, the pressure within the local reservoir 34 will become more negative causing the vacuum regulator valve 42 to be deactivated. Since the air has been evacuated from the local reservoir 34, the evacuated volume within the local reservoir 34 can eventually be replaced with fluid, allowing the back-pressure regulator to continue to operate.

Figure 5C:
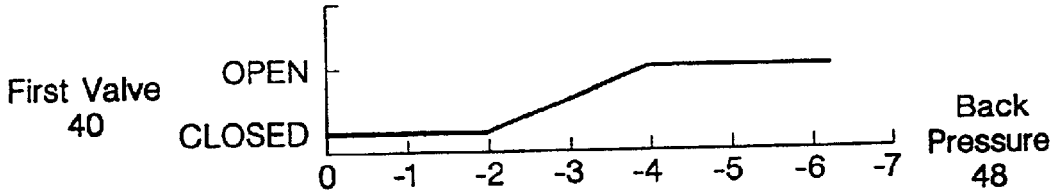
FIG. 5C is a graph showing the operation of a second valve used in the embodiment of the invention versus the back-pressure in a print cartridge.
Figure 5D:
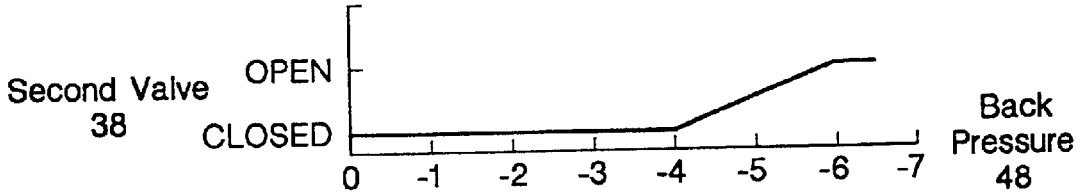
FIG. 5D is a graph showing the operation of a vacuum valve used in the embodiment of the invention to effectuate air purge capability versus the back-pressure in a print cartridge.
Figure 5E:
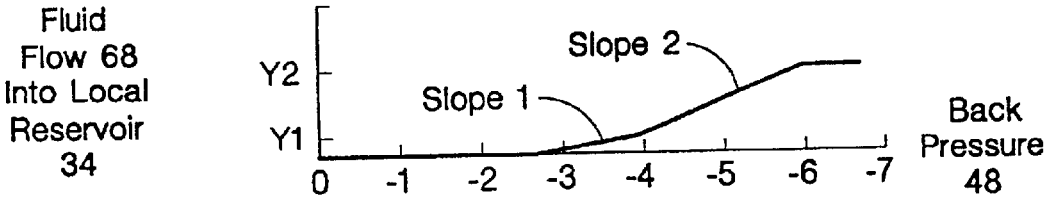
FIG. 5E is a graph showing the fluid flow into the print cartridge by combining the effects of the first and second valve operation to create a staged flow.

FIGS. 5C–5E are exemplary charts demonstrating the stage fluid flow operation of the invention shown in FIG. 3. In FIG. 5C, the operation of the first regulator valve 40 is compared to the back-pressure sensed by the pressure sensor 32. If the pressure sensed is less than −2 inches of water, the first regulator valve 40 is activated. The amount of fluid is modulated from −2 inches of water to −4 inches of water at which the first regulator valve 40 is fully activated. If the pressure sensed is greater than −2 inches of water, the first regulator valve 40 is deactivated. In FIG. 5D, the operation of the second regulator valve 38 is compared to the back-pressure sensed by the pressure sensor 32. If the pressure sensed is less than −4 inches of water, then the second regulator valve 38 is deactivate, else if the pressure sensed is more than −4 inches of water the second regulator valve 38 is activated. The fluid flow through the second regulator valve 38 is modulated until the pressure sensed is −6 inches of water at which the second regulator valve 38 is fully opened. Combining the operation of the first regulator valve 40 with the operation of the second regulator valve 38, provides the chart illustrated in FIG. 5E. This chart shows the fluid flow into local reservoir 34 versus the back-pressure sensed by pressure sensor 32. In this example, no fluid flows from 0 to −2 inches of water. Once the first regulator valve 40 opens, a first flow enters the local reservoir 34 and increases with a slope 1 up to a level of Y1. This first fluid flow continues until the back-pressure reaches −4 inches of water. At that time the second regulator valve 38 activates increasing the fluid flow into the local reservoir 34 to a level Y2 with an increase of slope 2. Depending on the needs of the printing system, the fluid flow from the first regulator valve 40 may be greater, equal, or less than the additional fluid flow from the second regulator valve 38. What is important over other pressure regulated printheads, such as that illustrated by FIG. 1, is that the flow of fluid into the printhead is provided in multiple stages of fluid flow, the multiple stages of fluid flow being dependent on the back-pressure sensed within the printhead. Slope 1 is designed to be preferably shallow to allow for low ink flow rates typically required in printing text information. Slope 2 is preferably steeper than slope1 to allow for high ink flow rates typically required in printing graphic information. Those skilled in the art will appreciate that the valve orifice and valve geometry can be modified to yield different slopes and thus different fluid flow characteristics and still meet the spirit and scope of the invention. Using the above technique, exemplary examples of physical embodiments of the invention are described and illustrated with respect to FIGS. 6A–12.

Figure 6A:
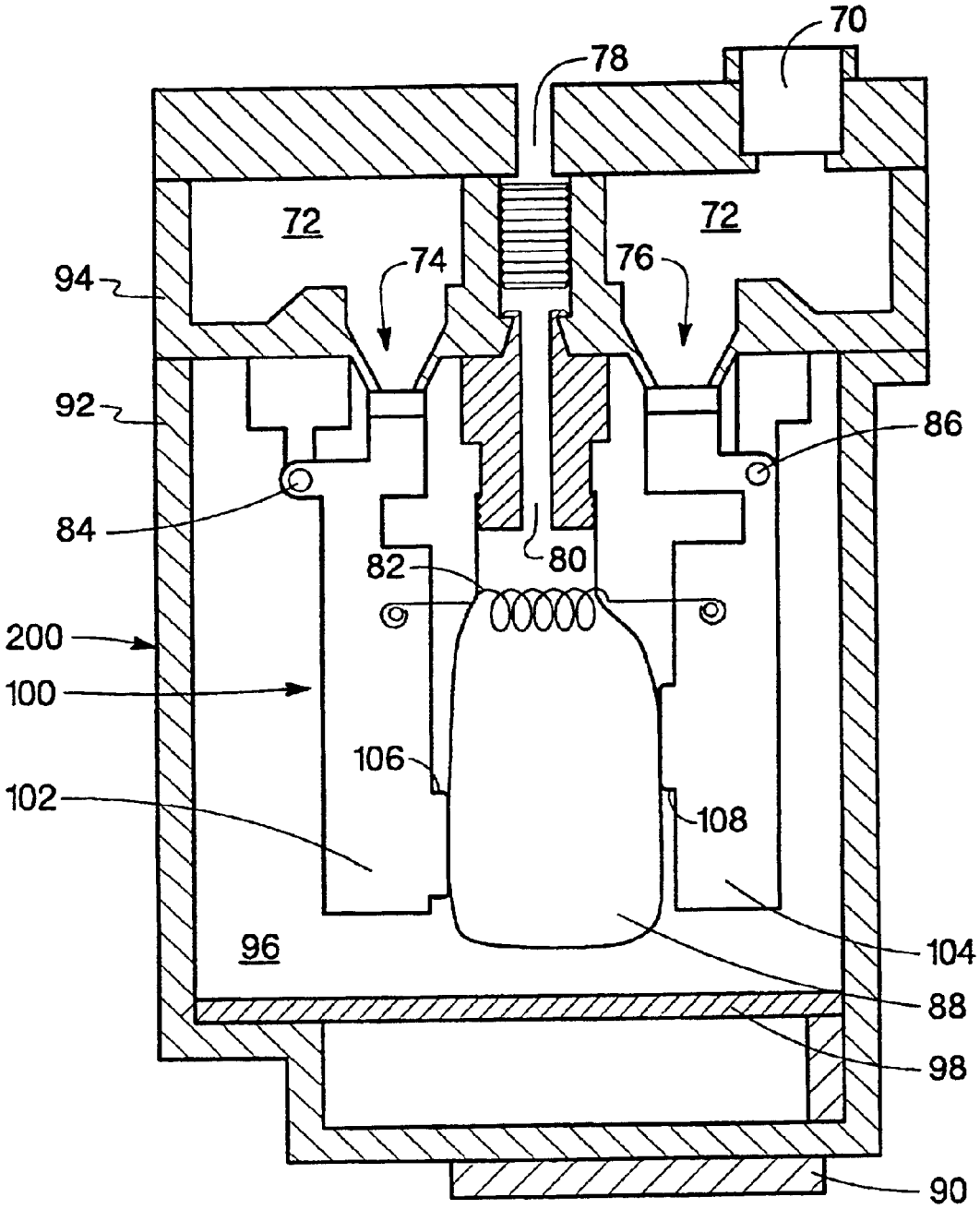
FIG. 6A is a partial cross-sectional drawing of one embodiment of the invention using multiple valves to create a staged fluid flow.

FIG. 6A is a partial cross-sectional diagram of one embodiment of the invention derived from the block diagram shown in FIG. 2. In this embodiment of a print cartridge 200, two valves are used to provide a staged flow of fluid into the local reservoir 96. The print cartridge 200 is made up of a crown 94, a base 92, and a back-pressure regulator 100. The base 92 has a local reservoir 96, a fluid screen 98 and a printhead 90. The screen 98 filters out unwanted particles from the fluid to prevent the printhead 90 from clogging. The crown 94 has a fluid inlet 70, an inlet reservoir 72, an orifice of first regulator valve 74, an orifice of second regulator valve 76, and back-pressure regulator 100. Back-pressure regulator 100 is made up of an air bag 88 with an inside that is vented to the atmosphere outside of print cartridge 200 through air vent 80 and air plug 78. Air bag 88 is allowed to expand or contract in response to the pressure within print cartridge 200. As air bag 88 expands, force is exerted on a first moment arm 102 and a second moment arm 104. The combination of the air bag 88, spring 82, and the moment arms act to form the pressure sensor 32 previously described. The air bag 88 is light weight, flexible, deformable, and non-elastic. The air bag 88 is preferably fabricated from a thin high barrier based film into four adjacent pockets to increase the contact of the air bag 88 with the moment arms to create a force. This force is counter balanced with a force exerted by spring 82 which is connected to the first moment arm 102 and the second moment arm 104. To apply different force levels on the moment arms, each moment arm has a moment contact area at unequal distances from pivot points on the respective moment arm. The first moment arm 102 has a first moment contact area 106 which is as far distant from the first pivot point 84 as possible. The second moment arm 104 has a second moment contact area 108 closer to the second pivot point 86 than the first moment contact area 106 is to the first pivot point 84. The first moment arm 102 forms a valve seat of the first regulator valve 74. The second moment arm forms a valve seat of the second regulator valve 76. The valve seat is preferably formed from a silicon elastomer.

The print cartridge 200 of FIG. 6A is functionally equivalent to the print cartridge 14 shown in FIG. 2. The air vent 80, air plug 78, air bag 88, spring 82, first moment contact area 106, and second moment contact area 108 are functionally equivalent to the pressure sensor 32 of FIG. 2. The inlet reservoir 72 is functionally equivalent to the inlet reservoir 18 shown in FIG. 2. The local reservoir 96 is functionally equivalent to the local reservoir 34 shown in FIG. 2. The first regulator valve 74, controlled by the pressure sensor through the use of first moment arm 102 and first pivot point 84, is functionally equivalent to the first regulator valve 40 of FIG. 2. The second regulator valve 76, controlled by the pressure sensor through the use of second moment arm 104 and second pivot point 86, is functionally equivalent to the second regulator valve 38 of FIG. 2. The printhead 90 functionally equivalent to the printhead 36 shown in FIG. 2.

Figure 6C:
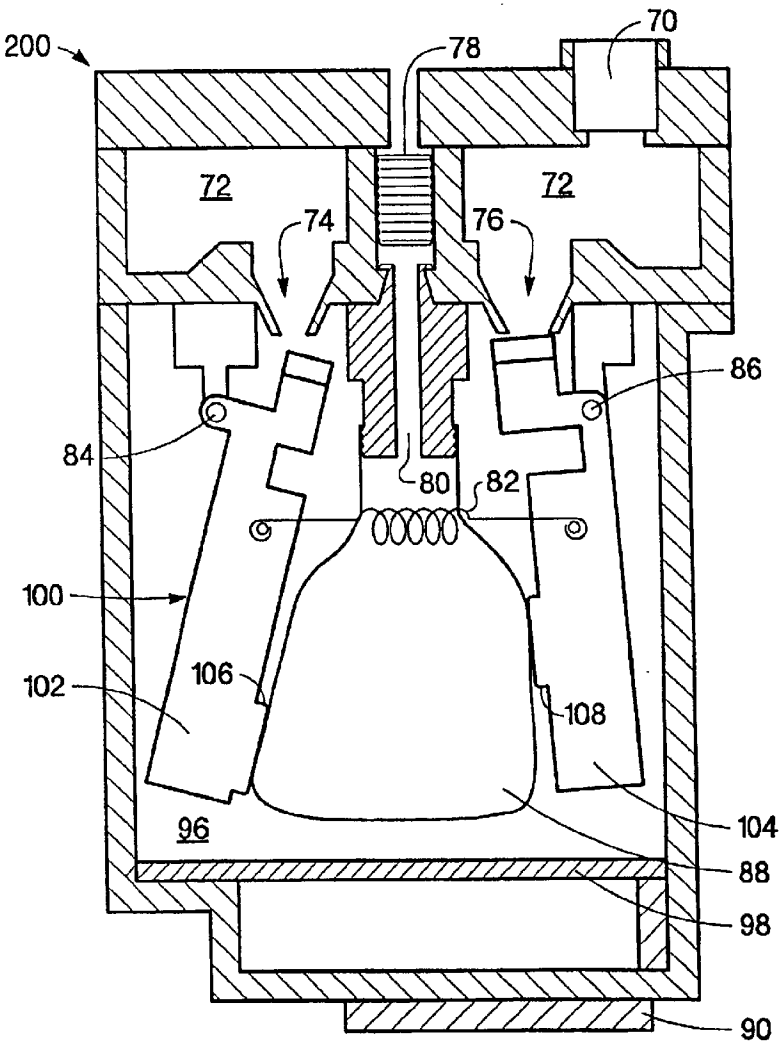
FIG. 6C is a partial cross-sectional drawing of the embodiment of FIG. 6A illustrating the first and second valve operating under high output conditions.
Figure 6B:
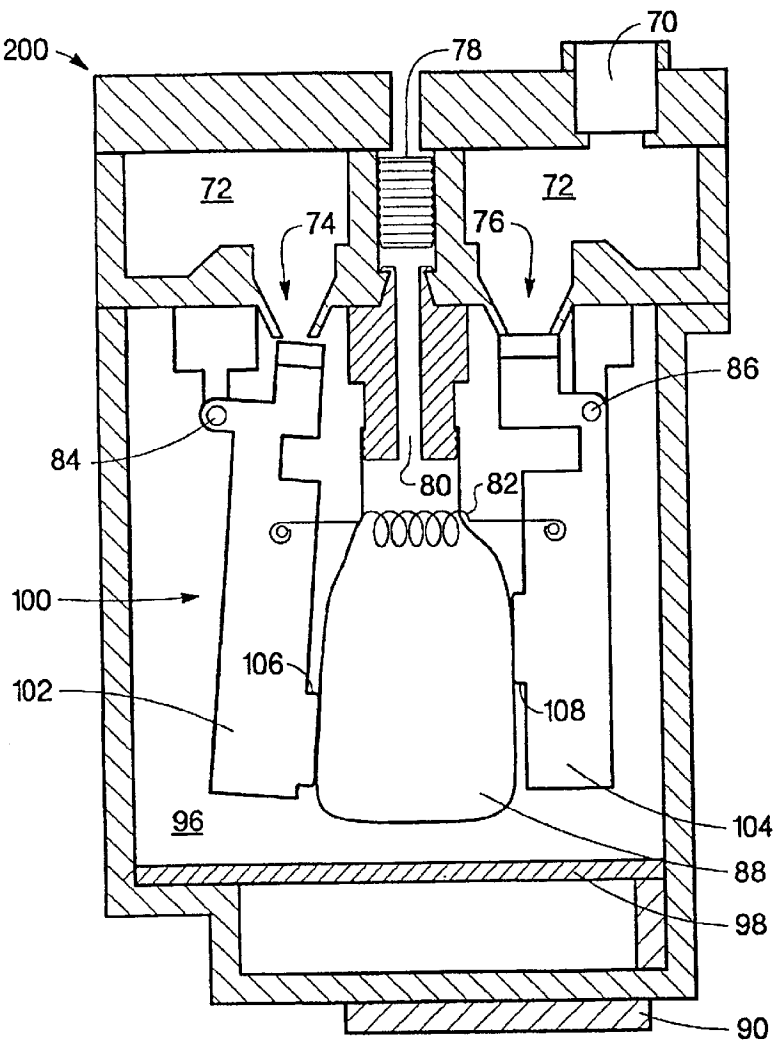
FIG. 6B is a partial cross-sectional drawing of the embodiment of FIG. 6A illustrating the first valve operation under normal conditions.

FIG. 6B illustrates the operation of this embodiment of the invention when the back-pressure in local reservoir 96 drops to a first predetermined level. As the pressure in local reservoir 96 drops, the air bag 88 expands since the inside of the air bag 88 is at atmospheric pressure and the outside of the air bag 88 is at the pressure of the local reservoir 96. The expanding air bag 88 presses on first moment contact area 106, causing first moment arm 102 to rotate around first pivot point 84. This rotation causes first regulator valve 74 to activate and open, thus allowing fluid from inlet reservoir 72 to flow into the local reservoir 96. As first moment arm 102 rotates, additional force is exerted on spring 82 which tends to keep second moment arm 104 from rotating. However, as the pressure in local reservoir 96 is further reduced, the air bag 88 continues to expand and create a larger force on first moment contact area 106 and second moment contact area 108. When a second predetermined back-pressure level has been reached and moment arm 102 hits the wall of the pen body, as shown in FIG. 6C, the second moment arm 104 rotates around second pivot point 86, activating and opening the second regulator valve 76. When this second regulator valve 76 opens, the first regulator valve 74 remains open, and both regulator valves allow fluid to flow into local reservoir 96.

Figure 7A:
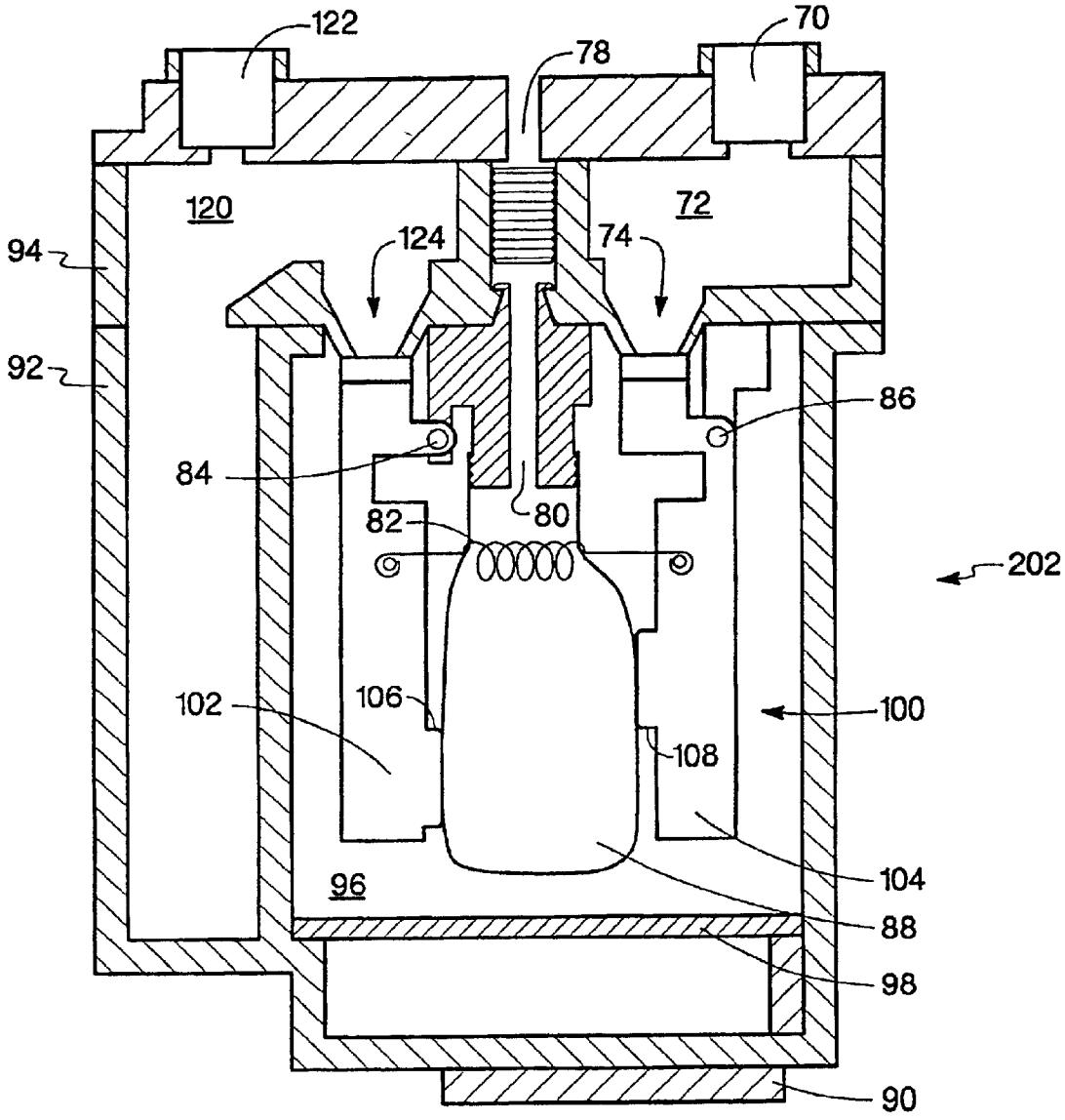
FIG. 7A is a partial cross-sectional drawing of a first alternative embodiment of the invention in which air purge capability is provided.

FIG. 7A is a partial cross-sectional drawing of a first alternative embodiment of the invention implementing a portion of the block diagram shown in FIG. 3 in which a vacuum valve 124 (vacuum valve 24 in FIG. 3) couples the local reservoir 96 to a vacuum reservoir 120 (vacuum reservoir 44 in FIG. 3). The print cartridge 202 is made up of a base 92 and crown 94. The base 92 has a portion of the vacuum reservoir 120, a screen 98, local reservoir 96 and printhead 90. The crown 94 includes a vacuum inlet 122 (vacuum inlet 46 in FIG. 3), fluid inlet 70 coupled to inlet reservoir 72, an orifice of vacuum valve 124, an orifice of a first regulator valve 74 and a back-pressure regulator 100. The back-pressure regulator has a first moment arm 102 with a first moment contact area 106 and a second moment arm 104 with a second moment contact area 108. The moment arms pivot around a first pivot point 84 and a second pivot point 86. The moment arms move about the pivot points due to the force exerted by air bag 88 and spring 82. The inside of air bag 88 is vented to the ambient atmosphere through air vent 80 and air plug 78. When the pressure within the local reservoir 96 decreases, the air bag expands, applying force on the first moment contact area 106 and the second moment contact area 108. Due to the location of the moment contact areas on their respective moment arms, the amount of rotational force delivered to the pivot points for each moment arm is different. When the pressure within the local reservoir approaches the ambient atmospheric pressure outside of the print cartridge 202, the air bag 88 essentially deflates and the moment arms are rotated about their respective pivot points by the force exerted by spring 82.

Figure 7C:
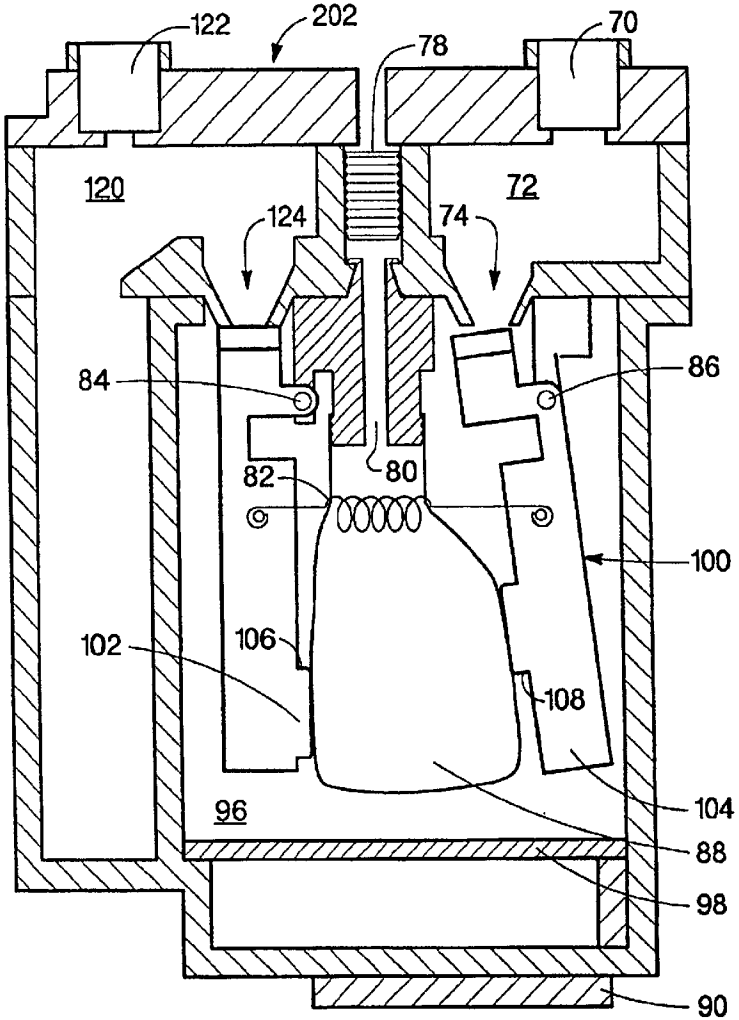
FIG. 7C is a partial cross-sectional drawing of the embodiment of FIG. 7A illustrating the fluid valve operation under normal operation.
Figure 7B:
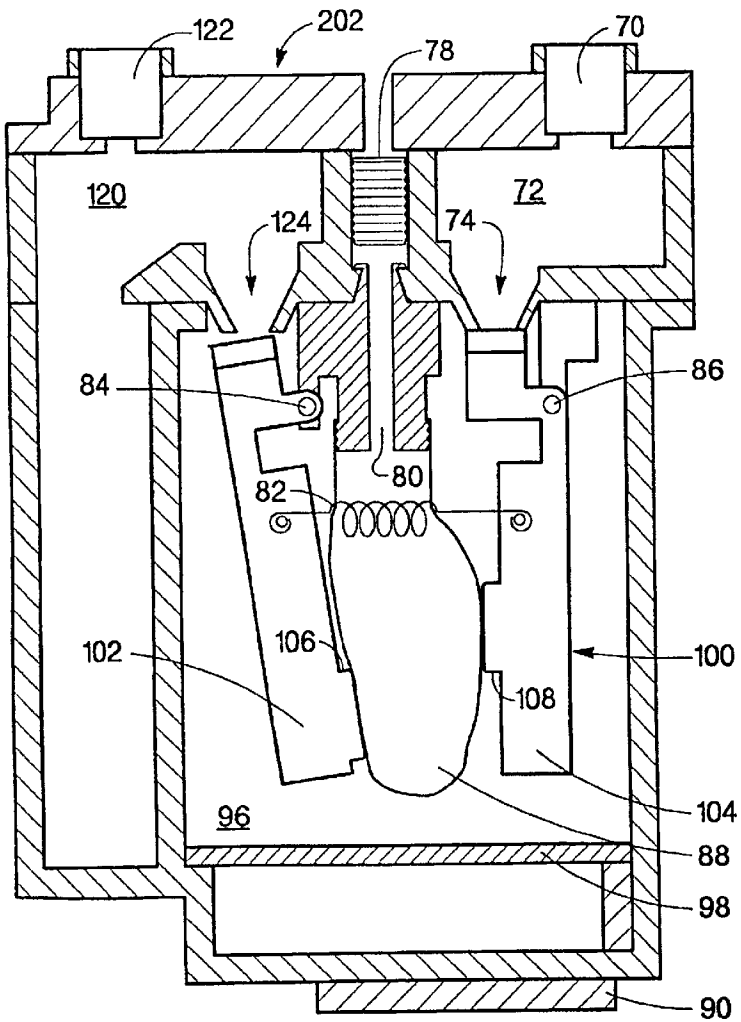
FIG. 7B is a partial cross-sectional drawing of the embodiment of FIG. 7A illustrating the vacuum valve opening due to the back-pressure approaching atmospheric levels.

As illustrated in FIG. 7B, in this first alternative embodiment, the first moment arm 102 has its pivot point 84 located such that the first moment arm 102 activates and opens vacuum valve 124 when the air bag 88 is deflated. When vacuum valve 124 is opened, any air, and possibly some fluid, within local reservoir 96 is expelled into vacuum reservoir 120. This action has the effect of lowering the pressure within the local reservoir 96, thus inflating air bag 88 until vacuum valve 124 is deactivated and closed essentially by the reactive movement of first moment arm 102.

FIG. 7C illustrates the operation of the first alternative embodiment of print cartridge 202 in which the fluid expelled by printhead 90 causes the pressure within local reservoir 96 to drop, thus causing air bag 88 to continue expanding and applying force on the moment arms. Since the first moment arm 102 is prevented from further rotation due to the closure of vacuum valve 124, the second moment arm 104 rotates around second pivot point 86, activating and opening first regulator valve 74. When first regulator valve 74 is opened, fluid is allowed into local reservoir 96 from inlet reservoir 72. As the fluid fills the volumetric space of local reservoir 96, the pressure within the local reservoir 96 will increase, causing the air bag 88 to deflate until first regulator valve 74 is deactivated and closed. Thus, depending on the designed opening and closing points of first regulator valve 74 and vacuum valve 124, a predetermined specified back-pressure range is controllable within local reservoir 96.

Figure 8A:
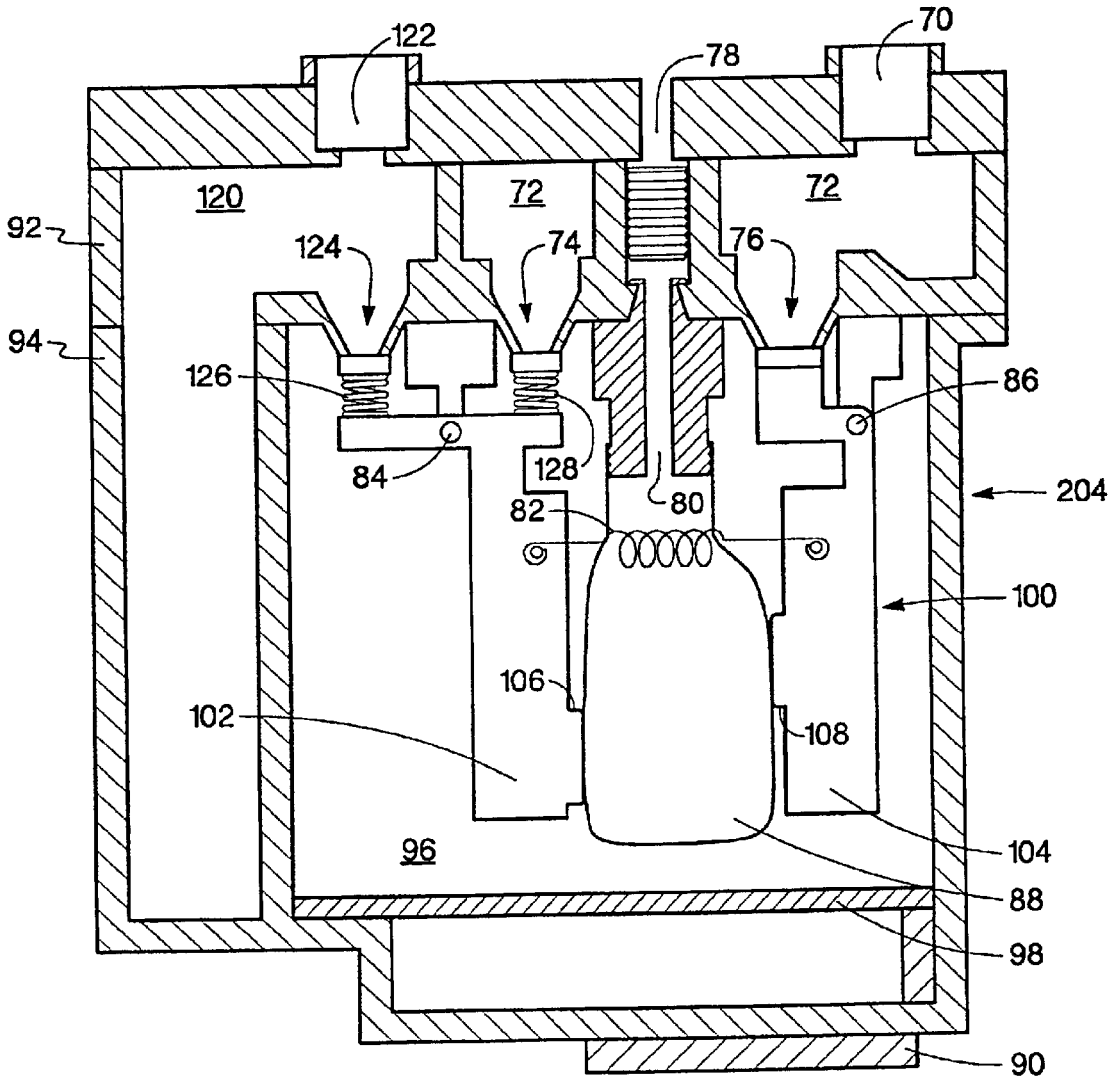
FIG. 8A is a partial cross-sectional drawing of a second alternative embodiment of the invention combining the staged fluid flows and air purge capability to provide improved back-pressure regulation.

FIG. 8A is a partial cross-sectional drawing of a second alternative embodiment of the invention which utilizes the print cartridge block diagram shown in of FIG. 3. In this example, three valves are used to control the pressure within local reservoir 96. The valve seat for first regulator valve 74 is attached to first moment arm 102 using a first valve spring 128. The valve seat for vacuum valve 124 is also attached to first moment arm 102 using a second valve spring 126. The vacuum valve 124 and the first regulator valve 74 are on opposite sides of the first pivot point 84. The second regulator valve 76 is attached to the second moment arm 104. The second alternative embodiment of print cartridge 204 has a base 92 and a crown 94. The base 92 has local reservoir 96, a fluid screen 98, a portion of the vacuum reservoir 120 and the printhead 90. The crown 94 contains the vacuum inlet 122, the fluid inlet 70 coupled to inlet reservoir 72, portions of the three valves, and the back-pressure regulator 100. The back-pressure regulator 100 is again made up of a first moment arm 102 having a first moment contact area 106, a second moment arm 104 having a second moment contact area 108, air bag 88, and spring 82. The inside of air bag 88 is coupled to the ambient atmospheric pressure through air vent 80 and air plug 78. The spring 82 is attached to the moment arms and acts as a counterbalancing force exerted on the moment arms from air bag 88. As the pressure within the local reservoir decreases, air bag 88 expands, causing the moment arms to move about their respective pivot points. When the pressure within local reservoir 96 approaches atmospheric pressure outside of print cartridge 204, the air bag 88 deflates, allowing the spring 82 to draw the two moment arms together.

Figure 8D:
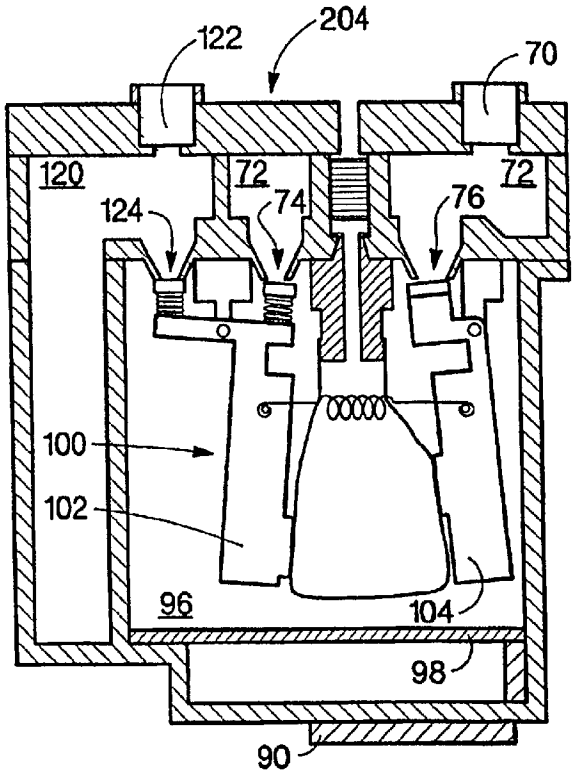
FIG. 8D is a partial cross-sectional drawing of the embodiment of FIG. 8A illustrating the first and second fluid valves operating under high output conditions.
Figure 8C:
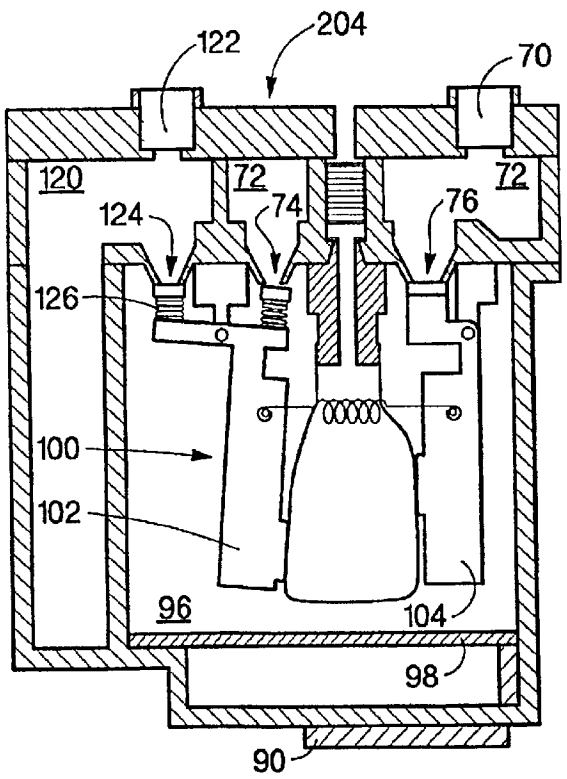
FIG. 8C is a partial cross-sectional drawing of the embodiment of FIG. 8A illustrating the first fluid valve opening under normal operation.
Figure 8B:
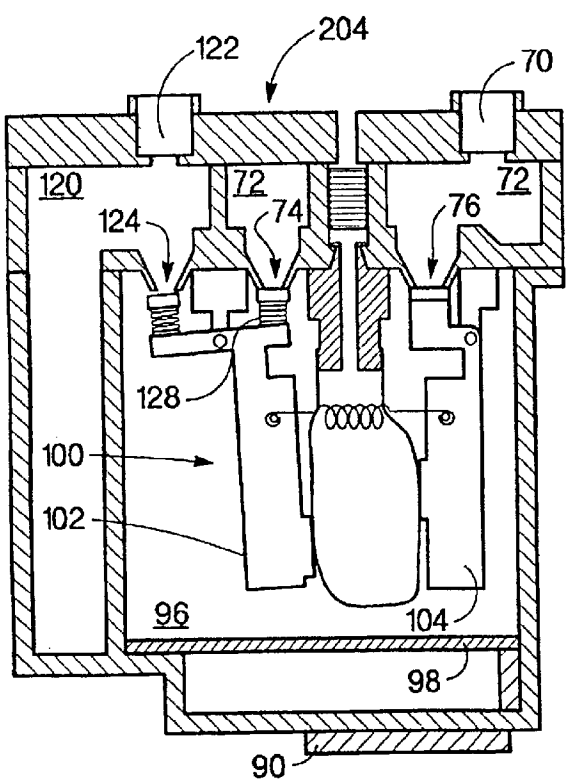
FIG. 8B is a partial cross-sectional drawing of the embodiment of FIG. 8A illustrating the vacuum valve opening due to the back-pressure approaching atmospheric levels.

FIG. 8B illustrates the operation of the second alternative embodiment when the pressure within the local reservoir 96 approaches the outside atmospheric pressure of print cartridge 204. The first valve spring 128 is compressed to allow the first moment arm 102 to rotate due to the spring 82 force and the deflation of air bag 88. In this instance, any air within the local reservoir 96 will be exhausted into the vacuum reservoir 120 and thus lower the pressure within the local reservoir 96 until the vacuum valve 124 deactivates and closes.

FIG. 8C illustrates the operation of the second alternative embodiment when the pressure within the local reservoir 96 is reduced enough to cause air bag 88 to expand and apply force on first moment arm 102. The second valve spring 126 is compressed to allow the first moment arm to rotate and activate first regulator valve 74 to open. When first regulator valve 74 is opened, fluid from inlet reservoir 72 is allowed to flow into the local reservoir 96. As the fluid enters the local reservoir 96, the pressure within the local reservoir 96 rises and first regulator valve 74 will be deactivated and close.

FIG. 8D illustrates the operation of the second alternative embodiment when the pressure within the local reservoir 96 is reduced due to a large amount of fluid flowing through printhead 90. In this instance, the air bag 88 expands causing both the first regulator valve 74 and the second regulator valve 76 to be activated due to the force exerted by the air bag 88 on the moment arm contact areas. By opening both regulator valves, the amount of fluid allowed to flow into the local reservoir 96 is increased and can match the fluid output by printhead 90. As printhead 90 quits ejecting fluid, the fluid entering the local reservoir 96 will fill the vacant volumetric space of the local reservoir 96, thus increasing the pressure within the local reservoir 96. This increased pressure causes the second regulator valve 76 to be deactivated until closed and when printhead 90 reduces its fluid output, eventually the first regulator valve 74 will be deactivated and closed.

Figure 9:
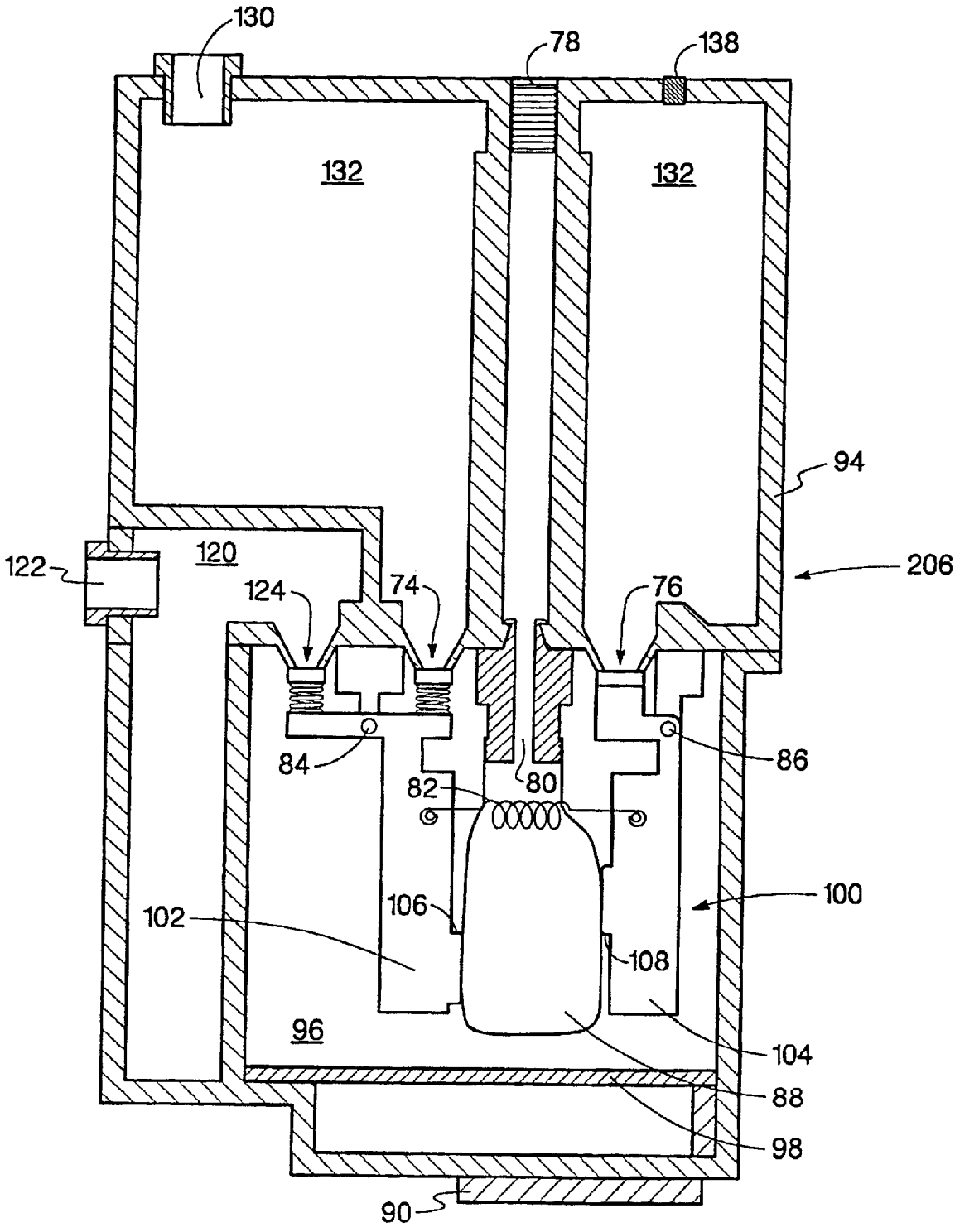
FIG. 9 is a partial cross-sectional drawing of a third alternative embodiment of the invention in which the fluid source is integral to the print cartridge.

FIG. 9 illustrates a third alternative embodiment of the invention, using the valve mechanism shown in FIG. 8A. The crown 94 of the print cartridge 206 contains a fluid source 132 with an optional refill inlet 130 and an optional air vent 138. This print cartridge 206 allows for operation in printing apparatus without having the need for separate fluid reservoirs. This approach allows the user of a media printing apparatus to simply replace or refill the print cartridge 206 when it becomes empty. Optional refill inlet 130 allows the print cartridge 206 to be refilled with fluid when needed. Optional air vent 138 allows the pressure within the fluid source 132 to remain at external atmospheric pressure to ensure the gravitational flow of fluid through the first regulator valve 74 and second regulator valve 76. The optional air vent 138 also provides a path for removal of internal air if the print cartridge 206 is refilled with fluid. The operation of the back-pressure regulator is as described above for FIGS. 8A–8D. The other back-pressure regulator embodiments previously discussed can also be used and still meet the spirit and scope of the invention.

Figure 10:
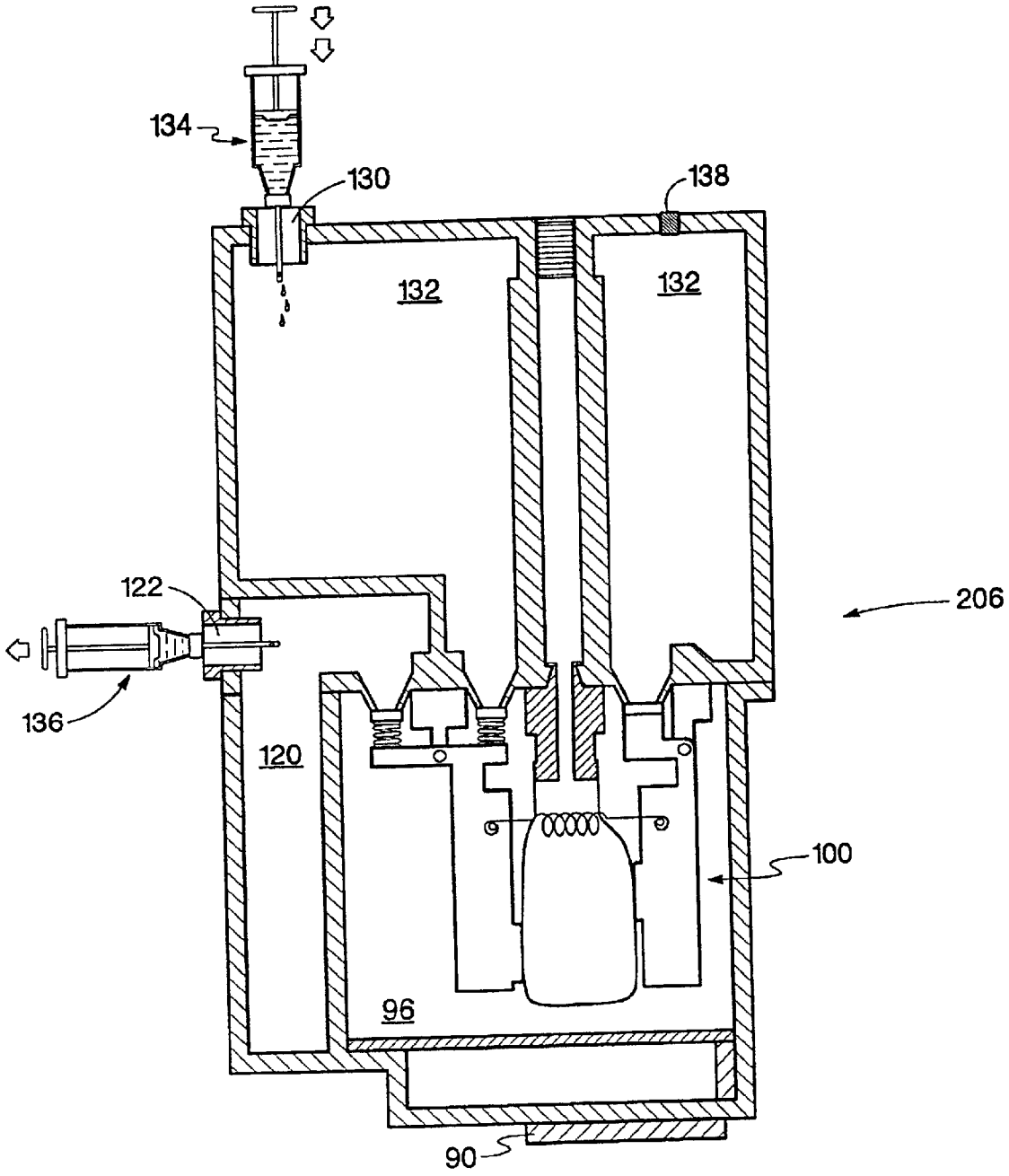
FIG. 10 is a partial cross-sectional drawing of the embodiment of FIG. 9 illustrating how the print cartridge is capable of being recharged.

FIG. 10 illustrates a method for refilling the third alternative embodiment of the invention. A first syringe 134 is filled with replacement fluid and inserted into refill inlet 130. The plunger of first syringe 134 is then pressed to force the replacement fluid within the first syringe 134 into the fluid reservoir 132. As the fluid enters fluid reservoir 132, any air within the reservoir is expelled through the optional air vent 138. A second syringe 136, which may be the first syringe 134, is placed in the vacuum inlet 122. The plunger of the second syringe 136 is then withdrawn from the second syringe 136 to evacuate any air that is in vacuum reservoir 120, thus creating a negative pressure within the vacuum reservoir 120.

Figure 11:
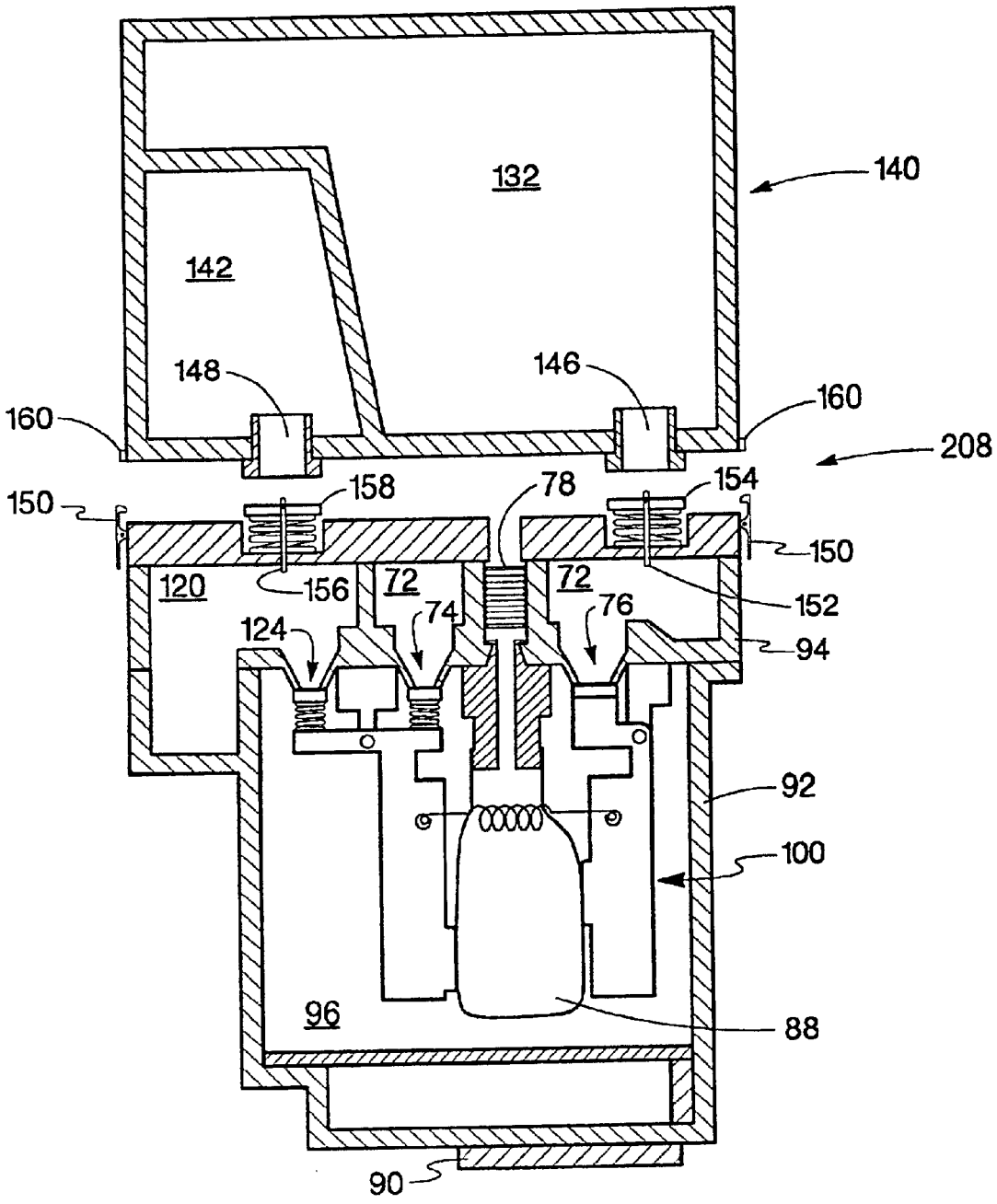
FIG. 11 is a partial cross-sectional drawing of a fourth alternative embodiment of the invention in which the fluid source and vacuum chamber are removable and replaceable.

FIG. 11 illustrates a fourth alternative embodiment of the invention in which a print cartridge 208, implementing the back-pressure regulator 100 shown in FIG. 8A, allows for removal and replacement of a fluid cartridge 140. The print cartridge 208 has a crown 94 and base 92. The base 92 is as described for the base shown in FIG. 8A. The crown 94 for this embodiment is made up of an inlet reservoir 72, vacuum reservoir 120, and back-pressure regulator 100. The back-pressure regulator can be any of the described embodiments and still meet the spirit and scope of the invention. The crown 94 also has snaps 150, a fluid needle 152, a fluid seal 154, a vacuum needle 156, and a vacuum seal 158. The fluid needle 152 is a hollow needle of conventional construction. The fluid seal 154 covers an opening in the fluid needle 152, and the vacuum seal covers an opening in the vacuum needle 156 when the fluid cartridge 140 is removed from the print cartridge 208. The seals are mounted on springs to allow for their withdrawal from the needle openings when a fluid cartridge 140 is inserted into the print cartridge 208. The fluid cartridge 140 has a fluid source 132, a vacuum source 142, snap receivers 160, a vacuum inlet 148, and a fluid inlet 146. The vacuum inlet 148 and fluid inlet 146 are preferably implemented as rubber septums of conventional construction with metal caps and a housing fabricated of a liquid crystal polymer or other suitable material. Snaps 150 attach to snap receivers 160 of the fluid cartridge 160 when connected to the print cartridge 208. The vacuum inlet 148 mates to vacuum needle 156 and vacuum seal 158 of the print cartridge 208. The fluid inlet 146 mates to the fluid needle 152 and the fluid seal 154 of the print cartridge 208. When a fluid cartridge 140 is empty, the user can disconnect the empty fluid cartridge 140 by using snaps 150 and disengaging the fluid cartridge inlets from the needles of the print cartridge 208. The empty fluid cartridge 140 can either be refilled/recharged or replaced with a new fluid cartridge 140. The user would insert the new fluid cartridge 140 onto the needles of the print cartridge 208 and lock the fluid cartridge 140 in place with the snaps 150 and snap receivers 160. An air channel (not shown) is engraved into crown 94 or fluid cartridge 140 to allow air to vent to the inside of air bag 88 through air plug 78.

Figure 12:
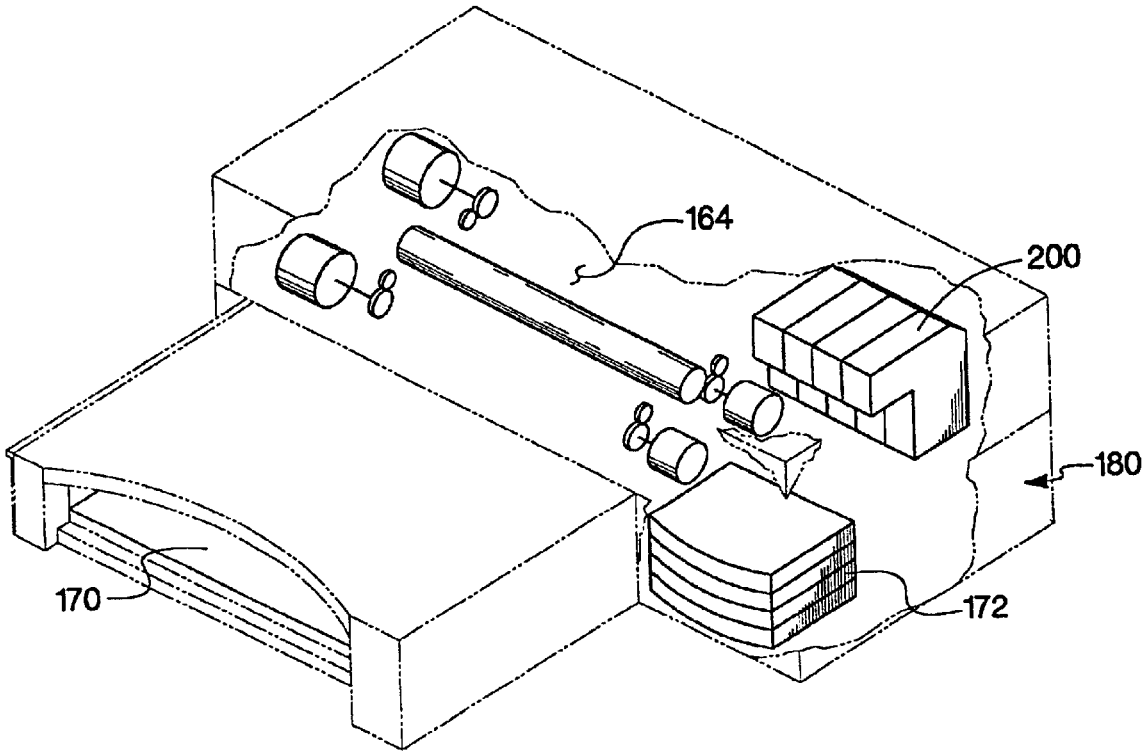
FIG. 12 is an isometric view of a printing apparatus using at least one embodiment of the invention.

FIG. 12 is an isometric drawing, partially shown opened, illustrating a media printing apparatus 180 such as a printer that contains at least one embodiment of the invention. Media printing apparatus 180 is made up of a media tray 170, a media feed mechanism 164, fluid supplies 172, and printheads 200.

The invention allows for high flow rates of fluid into a print cartridge having a printhead while still maintaining back-pressure stability at low flow rates from the printhead. This capability allows for both high speed and high quality printing such as that required for graphic imaging. This capability is achieved by providing staged flows of fluid into the print cartridge reservoir. In addition, the invention allows for tighter back-pressure control and stability by providing a method and apparatus to evacuate air that accumulates in the reservoir of the print cartridge. This capability allows for a long life print cartridge which increases reliability and lowers the consumer's operating costs.

Although specific embodiments of the invention have been described and illustrated, the invention is not limited to the specific forms or arrangements of parts so described and illustrated. For example, although the specific embodiments described herein are directed to thermal ink-jet printheads, the invention can be used with both piezoelectric and continuous flow printheads. In addition, although a staged fluid flow back-pressure regulator was illustrated and described as implemented by mechanical means, the staged fluid flow back-pressure regulator can be implemented with electrical and electronic sensors and valves controlled by logic or computer circuits and still meet the spirit and scope of the invention.

Further embodiments of the invention have been contemplated. One embodiment has the print cartridge having a plurality of regulator valves that are all in parallel which allow for variable flow rates that are required for certain types of printing other than text or graphic. For example, printing bar code labels continuously would require brief periods of variable flows of ink mixed with brief periods of no ink printing. The appropriate number of valves are opened corresponding to the level of ink required to produce the width of the instantly printed bar. By being able to adjust the flow of ink into the print cartridge based on the flow of ink out of the printhead, tighter back pressure regulation occurs. This technique then lends itself to allowing for dense and highly accurate bar code printing.

To accommodate very high quality printing, the weight of an ejected drop of ink is decreased. This reduction in drop weight means that any variation in the amount of ejected ink caused by the back-pressure regulation creates a larger percentage variation in drop weight during printing than if the ejected drops had a larger weight. Therefore, the instant invention provides for just such a tighter back-pressure regulation range required to accommodate ever finer droplets of ink. The invention allows for an even tighter range of back-pressure regulation than that which is described in the exemplary embodiments.

What is claimed is:

1. A method for regulating pressure in a print cartridge, comprising the steps of:

sensing the pressure;

activating a first flow valve when the pressure is less than a first predetermined limit;

deactivating the first flow valve when the pressure is not less than the first predetermined limit;

activating a second flow valve in parallel with said first flow valve to a fluid source when the pressure is less than a second predetermined limit; and deactivating the second flow valve when the pressure is not less than the is second predetermined limit.

2. The method of claim 1, further comprising the steps of:

activating a vacuum valve if the pressure is more than a third predetermined limit; and deactivating the vacuum valve if the pressure is not more than the third predetermined limit.

3. A method for regulating pressure in a print cartridge having a fluid source and a local reservoir, the method comprising the steps of:

sensing the pressure;

issuing a first flow of fluid from a first valve into the local reservoir from the fluid source when the pressure is less than a first predetermined limit; and issuing a second flow of fluid from a second valve into the local reservoir from the fluid source when the pressure is less than a second predetermined limit.

4. The method of claim 3, wherein said first flow of fluid has a volume flow rate, and said second flow of fluid has a volume flow rate equal to said volume flow rate of said first flow of fluid.

5. The method of claim 3, wherein said first flow of fluid has a volume flow rate, and said second flow of fluid has a volume flow rate not equal to said volume flow rate of said first flow of fluid.

6. A method for regulating pressure in a print cartridge having a fluid source and a local reservoir, the method comprising the steps of:

sensing the pressure;

issuing a first flow of fluid from a first valve into the local reservoir from the fluid source when the pressure is less than a first predetermined limit;

issuing a second flow of fluid from a second valve into the local reservoir from the fluid source when the pressure is less than a second predetermined limit; and evacuating air from the local reservoir when the pressure is more than a third predetermined limit.

* * * * *

UNITED STATES PATENT AND TRADEMARK OFFICE

CERTIFICATE OF CORRECTION

PATENT NO. : 6,840,605 B2
DATED : January 11, 2005
INVENTOR(S) : Hauck, Mark

It is certified that error appears in the above-identified patent and that said Letters Patent is hereby corrected as shown below:

Drawings,
Fig. 1, please insert the designation -- Prior Art -- next to "Fig. 1".

Column 7,
Line 14, delete "86" and insert therefor -- 66 --.

Signed and Sealed this

Fifth Day of July, 2005

JON W. DUDAS
*Director of the United States Patent and Trademark Office*